US009132669B2

(12) United States Patent
Kitahara

(10) Patent No.: US 9,132,669 B2
(45) Date of Patent: Sep. 15, 2015

(54) PRINTING CONTROL APPARATUS, PRINTING CONTROL METHOD, AND STORAGE MEDIUM

(71) Applicant: CANON KABUSHIKI KAISHA, Tokyo (JP)

(72) Inventor: Atsushi Kitahara, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/316,638

(22) Filed: Jun. 26, 2014

(65) Prior Publication Data

US 2015/0002573 A1 Jan. 1, 2015

(30) Foreign Application Priority Data

Jun. 28, 2013 (JP) ..... 2013-137056

(51) Int. Cl.
*B41J 29/38* (2006.01)
*B41J 11/00* (2006.01)

(52) U.S. Cl.
CPC ..... *B41J 11/008* (2013.01); *B41J 11/003* (2013.01)

(58) Field of Classification Search
USPC ..... 347/16
See application file for complete search history.

(56) References Cited

U.S. PATENT DOCUMENTS

2006/0192804 A1* 8/2006 Nakata et al. ..... 347/16
2011/0304886 A1* 12/2011 Hoover et al. ..... 358/1.18

FOREIGN PATENT DOCUMENTS

JP 6-72562 A 3/1994

* cited by examiner

*Primary Examiner* — Jason Uhlenhake
(74) *Attorney, Agent, or Firm* — Canon USA, Inc., I.P. Division

(57) ABSTRACT

There is provided a printing control apparatus configured to cause a printing unit to print an image on a printing medium. In the printing control apparatus, the printed image has a size determined based on a candidate, which is acquired by a sensor detecting the size of the printing medium and is one of the candidates for a size of the printing medium, corresponding to a combination of a plurality of conditions for specifying the size of the printing medium.

18 Claims, 9 Drawing Sheets

FIG.4A

| | | | |
|---|---|---|---|
| SHEET SIZE | SHEET WIDTH | SHEET LENGTH | ASPECT RATIO |
| L SIZE | 89.0 | 127.0 | 1.43 |
| Y6 WESTERN-STYLE ENVELOPE SIZE | 98.0 | 190.0 | 1.94 |
| POSTCARD SIZE | 100.0 | 148.0 | 1.48 |
| 4 × 6 SIZE | 101.6 | 152.4 | 1.50 |
| N3 LONG-TYPE ENVELOPE SIZE | 120.0 | 235.0 | 1.96 |
| 2L SIZE | 127.0 | 178.0 | 1.40 |
| DOUBLE POSTCARD SIZE | 200.0 | 148.0 | 0.74 |
| 6P SIZE | 203.2 | 254.0 | 1.25 |
| A4 SIZE | 210.0 | 297.0 | 1.41 |
| LETTER SIZE | 215.9 | 279.4 | 1.29 |
| 300 | 301 | 302 | 303 |

FIG.4B

| | | | | SHEET SIZE HAVING SIMILAR SHEET WIDTH | | | | | | | | | |
|---|---|---|---|---|---|---|---|---|---|---|---|---|---|
| SHEET SIZE | SHEET WIDTH | SHEET LENGTH | ASPECT RATIO | L SIZE | Y6 WESTERN-STYLE ENVELOPE SIZE | POSTCARD SIZE | 4 × 6 SIZE | N3 LONG-TYPE ENVELOPE SIZE | Photo 2L SIZE | DOUBLE POSTCARD SIZE | 6P SIZE | A4 SIZE | LETTER SIZE |
| L SIZE | 89.0 | 127.0 | 1.43 | – | | | | | | | | | |
| Y6 WESTERN-STYLE ENVELOPE SIZE | 98.0 | 190.0 | 1.94 | | – | × | × | | | | | | |
| POSTCARD SIZE | 100.0 | 148.0 | 1.48 | | × | – | × | | | | | | |
| 4 × 6 SIZE | 101.6 | 152.4 | 1.50 | | × | × | – | | | | | | |
| N3 LONG-TYPE ENVELOPE SIZE | 120.0 | 235.0 | 1.96 | | | | | – | | | | | |
| Photo 2L SIZE | 127.0 | 178.0 | 1.40 | | | | | | – | | | | |
| DOUBLE POSTCARD SIZE | 200.0 | 148.0 | 0.74 | | | | | | | – | × | × | × |
| 6P SIZE | 203.2 | 254.0 | 1.25 | | | | | | | × | – | × | × |
| A4 SIZE | 210.0 | 297.0 | 1.41 | | | | | | | × | × | – | × |
| LETTER SIZE | 215.9 | 279.4 | 1.29 | | | | | | | × | × | × | – |
| 300 | 301 | 302 | 303 | 304 | | | | | | | | | |

FIG.6

400

| | TYPE | PRIORITY COUNTRY | USE FREQUENCY |
|---|---|---|---|
| L SIZE | OTHERS | JP | HIGH |
| Y6 WESTERN-STYLE ENVELOPE SIZE | ENVELOPE | JP | LOW |
| POSTCARD SIZE | POSTCARD | JP | MODERATE |
| 4 × 6 SIZE | OTHERS | US | HIGH |
| N3 LONG-TYPE ENVELOPE SIZE | ENVELOPE | JP | LOW |
| 2L SIZE | OTHERS | JP | HIGH |
| DOUBLE POSTCARD SIZE | POSTCARD | JP | MODERATE |
| 6P SIZE | OTHERS | JP | LOW |
| A4 SIZE | OTHERS | JP | HIGH |
| LETTER SIZE | OTHERS | US | MODERATE |
| | 401 | 402 | 403 |

PRINTING CONTROL APPARATUS, PRINTING CONTROL METHOD, AND STORAGE MEDIUM

BACKGROUND OF THE INVENTION

1. Field of the Invention

The present invention relates to a printing control apparatus for controlling a printing apparatus to print an image on a printing medium, a printing control method, and a storage medium.

2. Description of the Related Art

There is a technique for scaling a printing target image according to a width of a sheet to be used by a printing apparatus detected by a sensor provided in a printing apparatus when printing is to be executed by the printing apparatus.

Japanese Patent Application Laid-Open No. 6-72562 discusses a technique in which a printing apparatus detects a width and a length of a sheet stored in each sheet cassette of the printing apparatus and specifies each of a plurality of sheet sizes corresponding to a detected width and a detected length. Further, a technique for uniquely specifying a sheet size from among a plurality of sheet sizes specified as described above according to a predetermined priority order based on a destination of the printing apparatus is also discussed.

However, with the technique discussed in Japanese Patent Application Laid-Open No. 6-72562, an appropriate sheet size may not be specified because the sheet size is specified according to a predetermined priority order.

For example, in Japanese Patent Application Laid-Open No. 6-72562, in a case where a plurality of sheet sizes is specified as candidates for a size of the printing sheet, a candidate at the highest order in the above priority order is always specified. Suppose, for example, a size A is placed at the highest priority for a certain destination of the printing apparatus from among sizes A, B, and C of the printing sheet. In this case, according to the technique discussed in Japanese Patent Application Laid-Open No. 6-72562, even if a user sets the size B or the size C printing sheets on the printing apparatus, the size A printing sheet at the highest priority order is always selected if the sizes A, B, and C are specified as the candidates. Therefore, although the user sets the size B or the size C printing sheet on the printing apparatus, the size A is specified as the size of the printing sheet, and thus an image having a size corresponding to the size A printing sheet may be printed on the size B or the size C printing sheet. As described above, with the technique discussed in Japanese Patent Application Laid-Open No. 6-72562, there may be a case where printing cannot be executed properly if the printing sheet having a size at the lower order in the predetermined priority order is set on the printing apparatus.

SUMMARY OF THE INVENTION

In order to solve the above problem, the present invention is directed to a printing control apparatus capable of controlling a printing apparatus to print an image having an appropriate size on a printing medium, a printing control method, and a storage medium.

Further features of the present invention will become apparent from the following description of exemplary embodiments with reference to the attached drawings.

BRIEF DESCRIPTION OF THE DRAWINGS

FIGS. 4A and 4B are sheet size tables according to an exemplary embodiment of the present invention.

FIG. 6 is a table illustrating a relationship between a sheet size and a priority level.

DESCRIPTION OF THE EMBODIMENTS

Various exemplary embodiments, features, and aspects of the invention will be described in detail below with reference to the drawings. Hereinbelow, an exemplary embodiment of the present invention will be described in detail.

Figure 1:
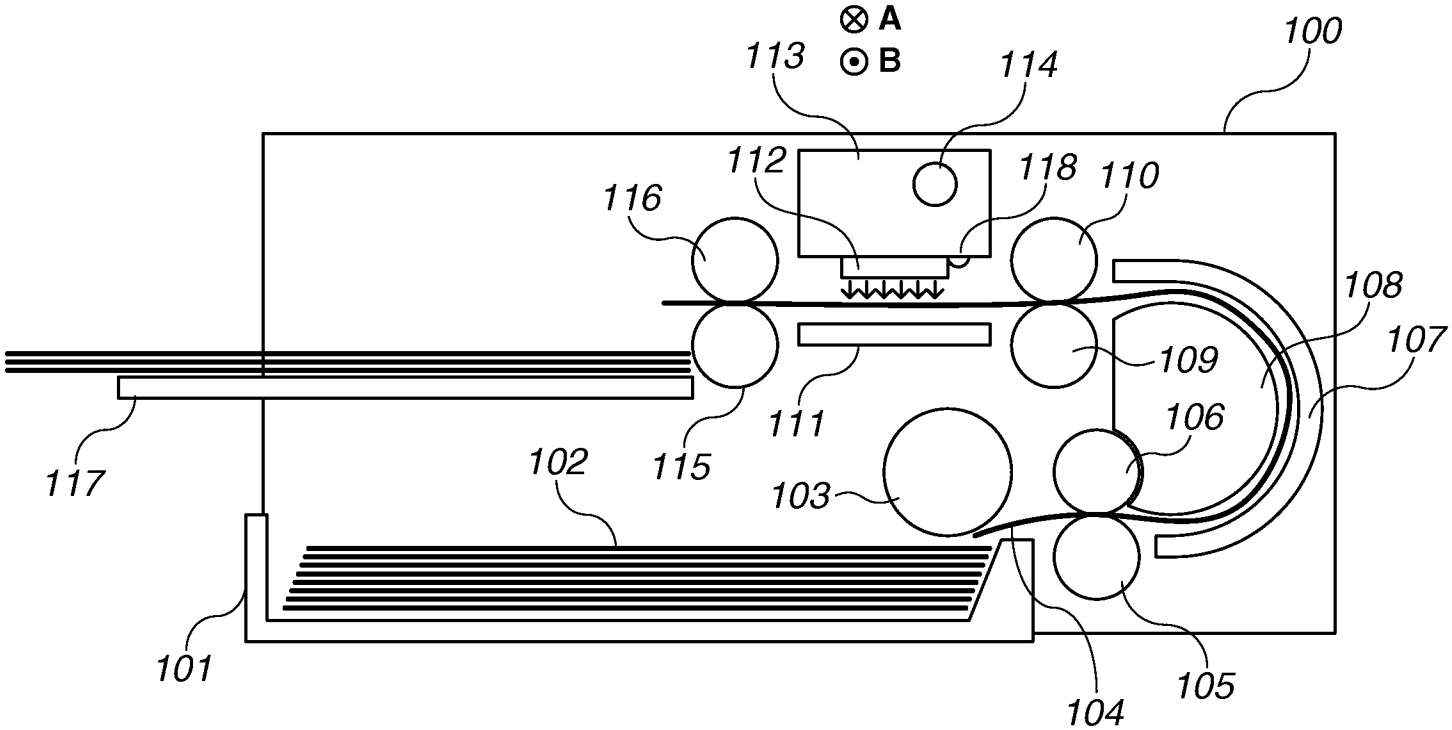
FIG. 1 is a diagram illustrating a printing mechanism included in a printing apparatus 100.

FIG. 1 is a diagram illustrating a printing mechanism included in a printing apparatus 100 according to a first exemplary embodiment of the present invention. Printing sheets are stored in a sheet feeding tray 101. A sheet feeding roller 103 feeds the printing sheets stored in the sheet feeding tray 101 to conveyance rollers 105 and 106. A printing sheet 104 is a printing sheet fed by the sheet feeding roller 103 and conveyed by the conveyance rollers 105 and 106. As illustrated in FIG. 1, the printing sheet 104 is conveyed to conveyance rollers 109 and 110 by the conveyance rollers 105 and 106 through a conveyance path configured of members 107 and 108. The conveyance rollers 109 and 110 convey the printing sheet 104 to a platen 111.

Further, a carriage 113 on which a printing head 112 is mounted is disposed on an upper portion of the platen 111. The carriage 113 performs scanning operation by reciprocally moving along a guide rail 114 in a direction A (direction toward the back side from the front side in FIG. 1) and a direction B (direction toward the front side from the back side in FIG. 1) illustrated in FIG. 1. The printing apparatus 100 causes the printing head 112 to discharge recording agent such as ink by applying a driving pulse thereto while causing the carriage 113 to perform scanning operation in the directions A and B. Through the above operation, the printing head 112 discharges the recording agent on the printing sheet 104, so as to print a printing target image on the printing sheet 104. The printing sheet 104 on which the image is printed is further conveyed to sheet discharge rollers 115 and 116 by the conveyance rollers 109 and 110. The sheet discharge rollers 115 and 116 discharge the printing sheet 104 to a sheet discharge tray 117.

Further, a sheet sensor 118, which is a reflective optical sensor, is disposed on the carriage 113. The printing apparatus 100 acquires an output level (output voltage) that indicates the intensity of light received by the sheet sensor 118 and determines whether that output level corresponds to an output level of the light reflected from the printing sheet 104, so as to detect whether the printing sheet 104 exists at a position where the light has been received from. In addition, as described above, the sheet sensor 118 is disposed on the carriage 113 to perform scanning operation together with the printing head 112. Therefore, the printing apparatus 100 can determine end portions of the printing sheet 104 in a scanning range of the sheet sensor 118 by detecting whether the printing sheet 104 exists within the scanning range thereof. Then, based on a distance between the end portions on the right and the left sides of the printing sheet 104, the printing apparatus 100 can detect a width of the printing sheet 104. Details of the above-described detection processing will be described with reference to FIG. 2. A scanning position of the sheet sensor 118 (carriage 113) is detected by an encoder 224 described below.

The printing apparatus 100 includes the above-described sheet feeding tray 101, the platen 111, the printing head 112, the carriage 113, the guide rail 114, the sheet discharge tray 117, and the various rollers as the printing mechanisms.

Figure 2:
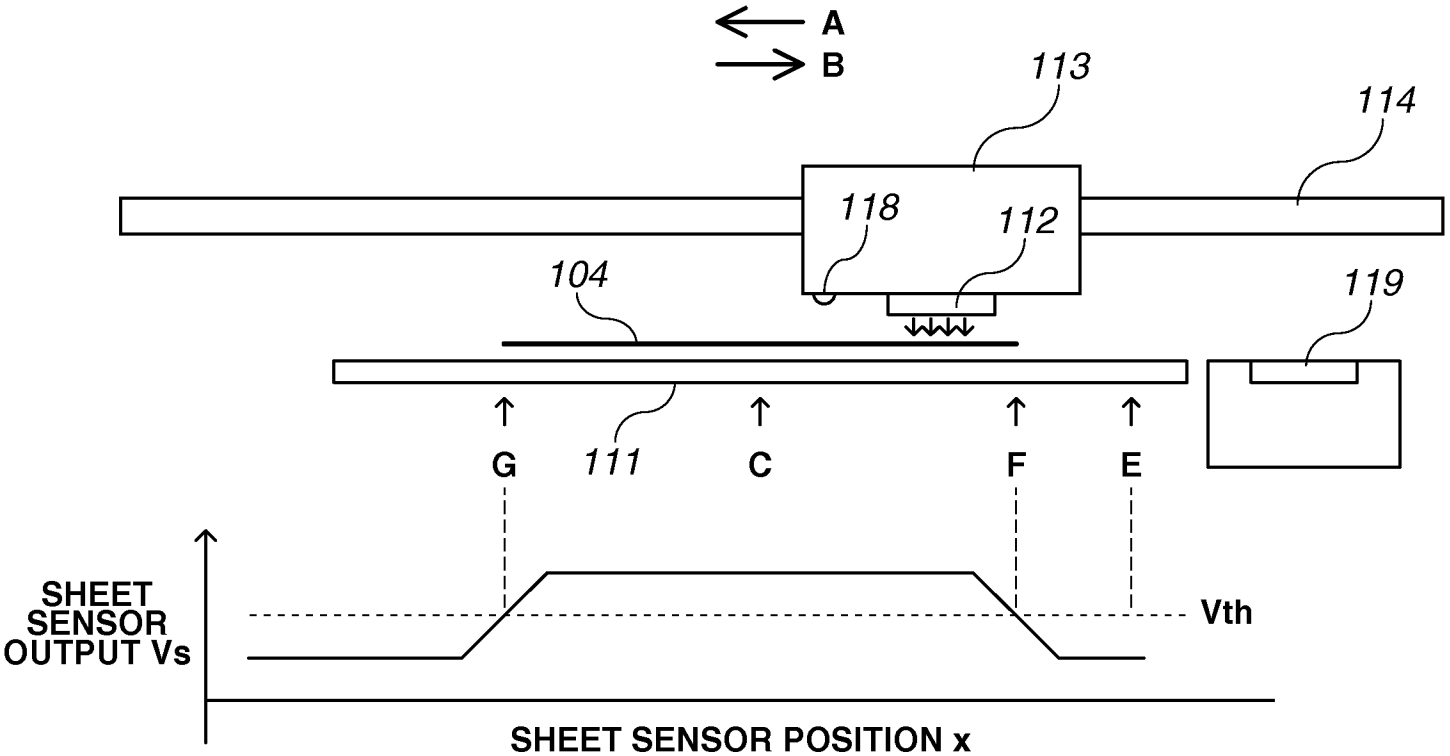
FIG. 2 is a diagram illustrating sheet width detection executed by a sheet sensor 118.

FIG. 2 is a diagram illustrating sheet width detection executed by the sheet sensor 118.

As described above, the printing apparatus 100 prints an image on the printing sheet 104 by causing the printing head 112 to discharge recording agent while reciprocally moving the carriage 113 along the guide rail 114 in the directions of arrows A and B. Further, a head recovery mechanism 119 for performing a capping operation of the printing head 112 is disposed on a position different from the position of the platen 111 in a moving range of the carriage 113.

The sheet sensor 118 scans the platen 111 to receive light, so as to detect the output level of the received light. A graph in FIG. 2 illustrates an output level detected by the sheet sensor 118 in the moving range of the carriage 113 (i.e., a position x of the sheet sensor 118). The position x of the sheet sensor 118 is specified by a position of the carriage 113 detected by the encoder 224 described below. In the present exemplary embodiment, the printing sheet 104 has a bright color such as white whereas the platen 111 has a dark color such as black. Therefore, a high output level (high-intensity light reflected from the printing sheet 104) is acquired from a position where the printing sheet 104 exists on the platen 111 whereas a low output level (low-intensity light reflected from the platen 111) is acquired from a position where the printing sheet 104 does not exist.

The sheet sensor 118 receives the light reflected from a position E of the platen 111 when the carriage 113 is located at the position of the head recovery mechanism 119. Then, when the carriage 113 moves in the direction A, the output level is increased at the position corresponding to the end portion of the printing sheet 104. Then, the acquired output level remains constant from one end portion to the opposite end portion of the printing sheet 104, and drops at the another end portion.

In the present exemplary embodiment, in a case where the sheet sensor 118 detects the output level that exceeds a predetermined threshold value Vth, it is determined that the printing sheet 104 exists at the position from which that output level is detected. Specifically, a position G and a position F in FIG. 2 are the positions of the end portions of the printing sheet 104, and thus an area between the position G and the position F is regarded as the area where the printing sheet 104 exists. Therefore, a distance between the position G and the position F is detected as the sheet width of the printing sheet 104.

In the present exemplary embodiment, in order to adjust the center of the printing sheet 104 to a central position C of the platen 111, the printing apparatus 100 conveys the printing sheet 104 in a centered state. At this time, if the printing sheet 104 is large in size and the right end of the printing sheet 104 crosses over the right side of the position E in FIG. 2, the printing apparatus 100 may not be able to detect the right end of the printing sheet 104.

Therefore, in the present exemplary embodiment, in a case where the right end of the printing sheet 104 crosses over the right side of the position E, the printing apparatus 100 determines the sheet width of the printing sheet 104 based on the distance between the central position C and the position G at the left end of the printing sheet 104. More specifically, in a case where the output level at the position E exceeds the threshold value Vth, it is determined that the right end of the printing sheet 104 is positioned either at the position E or at a position of the right side of the position E. In a case where the position thereof is thus determined, a length acquired by doubling the distance between the central position C and the position G is detected as the sheet width of the printing sheet 104. This is why the printing apparatus 100 conveys the printing sheet 104 in such a manner that the center thereof coincides with the central position C, the distance between the central position C and the position G at the left end of the printing sheet 104 is a half the length of the sheet width thereof. Therefore, the printing apparatus 100 can detect the length acquired by doubling the distance between the central position C and the position G as the sheet width. Further, a value that represents the central position C in the scanning range of the carriage 113 is previously stored in a memory in the printing apparatus 100, so that the printing apparatus 100 can acquire the distance between the central position C and the position G by referring to this value.

In addition, the above threshold value Vth does not have to be a fixed value. For example, the threshold value Vth may be changed according to the output level at the position E. Further, the threshold value Vth may be determined according to the intensity of the reflected light caused by characteristics of a surface of the printing medium. More specifically, the threshold value Vth is changed according to a sheet type (such as a normal paper or a glossy paper) used for printing. Further, as a method for detecting presence or absence of the printing sheet, a method for detecting presence or absence of the printing sheet from a comparison result of the output levels between the position E and other positions may be employed instead of employing the above-described method for determining whether the output level exceeds the threshold value Vth. For example, in a case where the printing apparatus 100 determines that the printing sheet does not exist at the position E based on the output level at the position E, the printing apparatus 100 may determine that the printing sheet exists at the position having the output level greater than the output level of the position E by a predetermined value.

Further, in the method illustrated in FIG. 2, the sheet sensor 118 is disposed on the carriage 113, so that the sheet sensor 118 is moved to execute the detection processing. However, it is not limited thereto. For example, the sheet sensor 118 may be disposed on the platen 111 separated from the carriage 113. In this case, a plurality of the sheet sensors 118 corresponding to the width of the conveyance path of the printing sheet is arranged, so that the printing apparatus 100 can determine the width of the printing sheet by determining whether the respective sheet sensors 118 detect the presence of the printing sheet.

Figure 3:
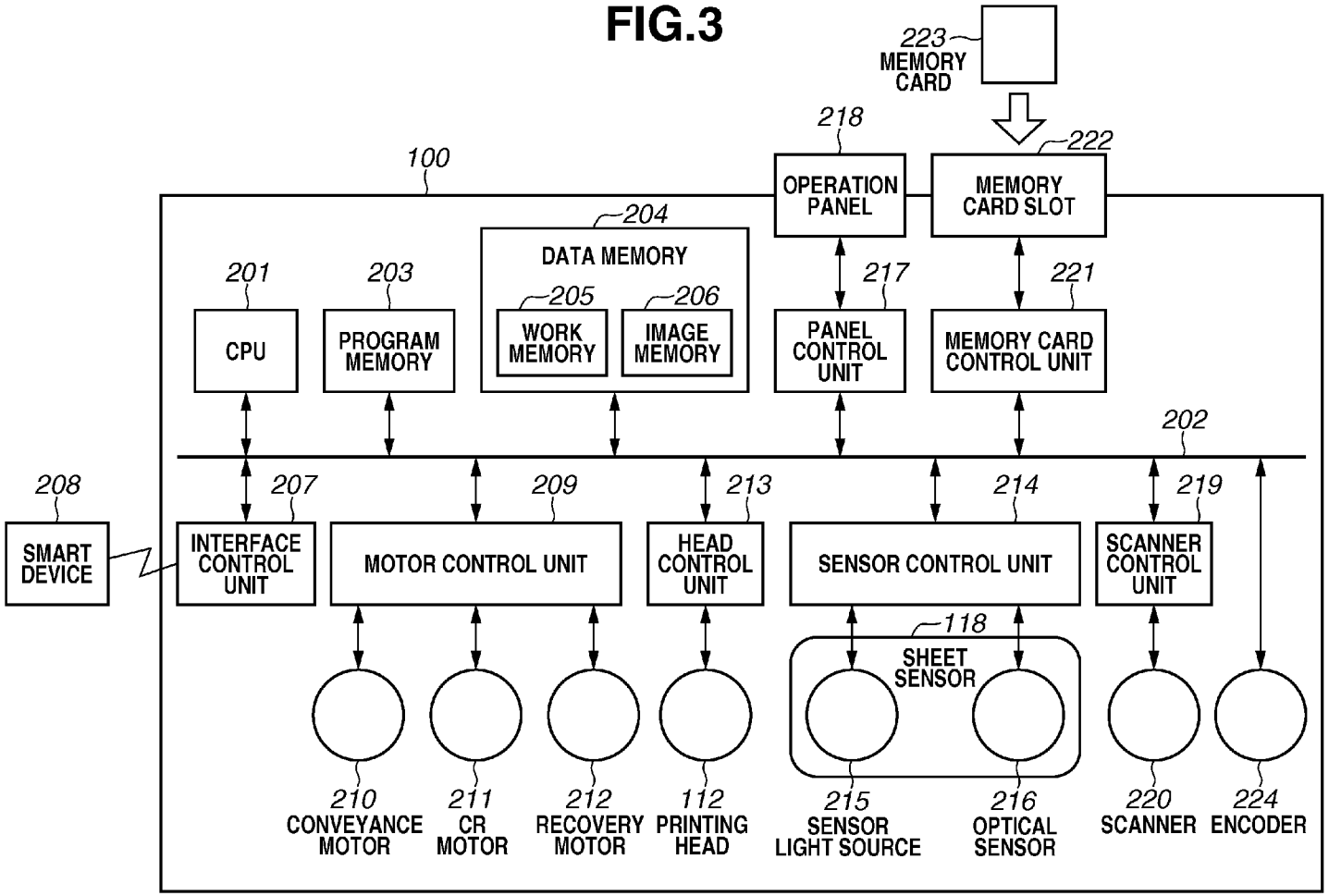
FIG. 3 is a block diagram illustrating a configuration of the printing apparatus 100.

Next, a configuration of the printing apparatus 100 will be described. FIG. 3 is a block diagram illustrating the configuration of the printing apparatus 100.

A central processing unit (CPU) 201 is a processor for controlling the printing apparatus 100. The CPU 201 is connected with a program memory 203 such as a read only memory (ROM) or a hard disk, and a data memory 204 such as a random access memory (RAM) via an internal bus 202. A program for controlling the printing apparatus 100 is stored in the program memory 203. The CPU 201 can control the printing apparatus 100 by reading the program stored in the program memory 203 to the data memory 204 and executing that program on a work memory 205 allocated to the data memory 204. Further, an image memory 206 is also allocated to the data memory 204, so that the CPU 201 rasterizes various kinds of data such as image data to be printed by the printing apparatus 100 onto the image memory 206.

An interface control unit 207 communicates with a smart device 208 such as a smartphone via an interface by being controlled by the CPU 201. For example, the interface control unit 207 receives a printing target job from the smart device 208, and notifies the smart device 208 of status information of the printing apparatus 100. In addition, the interface control unit 207 may communicate therewith through either a wired interface such as a universal serial bus (USB) cable, or a wireless interface such as an infrared communication or a wireless local area network (LAN). For example, the smart device 208 may be a smartphone or a tablet terminal. In addition, a mobile terminal such as a mobile phone or a personal digital assistance (PDA) may also operate as the smart device 208 according to the present exemplary embodiment.

Further, a communication destination is not limited to the smart device 208 but can be a personal computer. Additionally, the communication destination may be an apparatus such as a server connected thereto via a network, or a facsimile apparatus or a digital television connected thereto via a telephone line. Furthermore, in addition to the case where the data of the printing target is included in the print job, the printing apparatus 100 may acquire data of the printing target from the external apparatus such as the server according to address information included in the print job.

A motor control unit 209 controls various motors for driving the print mechanisms of the printing apparatus 100 according to the control by the CPU 201. A conveyance motor 210 drives the sheet feeding roller 103, the conveyance rollers 105, 106, 109, 110, and the sheet discharge rollers 115, 116 illustrated in FIG. 1 according to the control by the motor control unit 209. A carriage (CR) motor 211 drives and reciprocally moves the carriage 113 according to the control by the motor control unit 209. Further, a recovery motor 212 drives the head recovery mechanism 119 according to the control by the motor control unit 209.

According to the control by the CPU 201, a head control unit 213 controls the printing head 112 and causes the printing head 112 to discharge a recording agent such as ink. The CPU 201 causes the printing head 112 to perform a scanning operation to print an image on the printing sheet 104 by driving both the printing head 112 and the conveyance motor 210. In other words, the CPU 201 included in the printing apparatus 100 operates as a printing control apparatus and controls the various motors and the printing head 112 serving as the printing mechanisms in order to cause the printing mechanisms to print an image.

According to the control by the CPU 201, a sensor control unit 214 causes a sensor light source 215 included in the sheet sensor 118 to emit light, and causes an optical sensor 216 included in the sheet sensor 118 to receive reflected light. Further, the sensor control unit 214 acquires an output level indicating the intensity of light received by the optical sensor 216. The CPU 201 can execute the sheet width determination illustrated in FIG. 2 by acquiring the output level acquired by the sensor control unit 214. Further, through the processing described below, the CPU 201 determines the sheet size including a sheet length according to the sheet width determined as the above.

A panel control unit 217 controls an operation panel 218 according to the control by the CPU 201. The operation panel 218 includes an operation device such as keys or a touch-panel through which the user can perform operations, and a display panel which displays various kinds of information such as an image. For example, when the user operates the operation device of the operation panel 218, an instruction from the user is input to the panel control unit 217, and that instruction is further input to the CPU 201. Further, according to an instruction from the CPU 201, the panel control unit 217 displays an image rasterized on the image memory 206 onto the display panel of the operation panel 218.

According to the control by the CPU 201, a scanner control unit 219 controls the scanner 220 to read a document placed on a document positioning plate of the scanner 220 to acquire the read image. Further, the scanner control unit 219 stores the read image in the image memory 206. A memory card control unit 221 writes and reads various kinds of data to/from a memory card 223 mounted on a memory card slot 222 according to the control by the CPU 201.

The encoder 224 specifies a position of the carriage 113 when the carriage 113 moves along the guide rail 114 to perform a scanning operation. The CPU 201 specifies a position x of the sheet sensor 118 illustrated in FIG. 2 based on the position of the carriage 113 specified by the encoder 224 and the mounting position of the sheet sensor 118 on the carriage 113.

In the present exemplary embodiment, as described above, the CPU 201 determines the sheet size which includes the sheet length according to the sheet width determined by the sheet sensor 118. In the printing apparatus 100 of the present exemplary embodiment, the sheet sensor 118 is disposed on the carriage 113 together with the printing head 112. Then, respective members such as various motors and the guide rail 114 for moving the carriage 113, and the encoder 224 for specifying the position of the carriage 113 are commonly used for the printing processing and the sheet width detection, which are respectively executed by the printing head 112 and the sheet sensor 118. Therefore, the above members used for the sheet width detection does not have to be provided separately from the members used for the printing processing, and thus the printing apparatus 100 can be prevented from being increased in size.

FIGS. 4A and 4B are sheet size tables according to the present exemplary embodiment. The sheet size management table of FIG. 4A includes a sheet size 300 that can be used by the printing apparatus 100, and a sheet width 301, a sheet length 302, and a horizontal-to-vertical ratio (aspect ratio) 303 of the sheet size 300. Further, a measurement unit for the sheet width 301 and the sheet length 302 is "millimeter (mm)".

The sheet size table is stored in the program memory 203, so that the CPU 201 can refer to the sheet size table by reading out the sheet size table from the program memory 203 to the data memory 204. Various methods for storing the sheet width 301 by associating the sheet width 301 with the sheet size may be employed in addition to the above method in which the information of the sheet width 301 is stored in a table format.

In the present exemplary embodiment, the CPU 201 determines the size of the printing sheet 104 according to the sheet width detected by the sheet sensor 118. Specifically, on the sheet size table, the CPU 201 specifies the sheet size 300 having the sheet width 301 included in a predetermined range of the sheet width detected by the sheet sensor 118 as the size of the printing sheet 104 being conveyed in the printing apparatus 100. This predetermined range is provided because an error may occur in a detection result of the sheet sensor 118 and an actual sheet width if the intensity of light reflected from the printing sheet 104 is changed due to a state of the printing sheet 104 or an installation environment of the printing apparatus 100.

Therefore, in a case where the sheet sensor 118 detects the sheet width as 126.0 mm while the above predetermined range is set to plus or minus 3 mm, for example, the sheet size 300 corresponding to the sheet width 301 included in a range of 123.0 mm to 129.0 mm will be specified as a candidate for the size of the printing sheet 104. In this case, as illustrated in the sheet size table of FIG. 4A, a 2L size which corresponds to the sheet width 301 of 127.0 mm is specified as the candidate.

In addition, the sheet size may not be uniquely specified but a plurality of sheet sizes having the sheet widths of similar values may be specified as the candidates for the size of the printing medium. For example, in a case where the sheet sensor 118 detects the sheet width as 99.0 mm, a Y6 western-style envelope size (sheet width of 98.0 mm), a postcard size (sheet width of 100.0 mm), and a 4×6 size (sheet width of 101.6 mm) are included in a sheet width range of 96.0 mm to 102.0 mm. Likewise, in a case where the sheet width is detected as 213.0 mm, an A4 size (sheet width of 210.0 mm) and a letter size (sheet width of 215.9 mm) are specified as the candidates for the sheet size.

In the present exemplary embodiment, in a case where a plurality of the sheet sizes are specified as the candidates for the sheet size of the printing sheet 104, the sheet size of the printing sheet 104 is determined according to destination information of the printing apparatus 100. The sheet size determination processing will be described below in detail with reference to FIGS. 5 through 8.

As described with reference to FIG. 2, in the present exemplary embodiment, in a case where the printing sheet 104 is large in size, one end of the printing sheet 104 may not be detected by the sheet sensor 118. In this case, the sheet width is determined by the calculation based on the distance between the central position C and the position G. In this case, due to the characteristics of the printing sheet 104, for example, the printing sheet 104 may be conveyed while the center thereof is deviated from the central position C. Therefore, in a case where one end of the printing sheet 104 is not detected, the predetermined range may be set to be a comparatively wide range such as ±10 mm instead of ±3 mm. In this case, if the sheet width is detected as 210 mm, a double postcard size (sheet width of 200.0 mm), a 6P size (sheet width of 203.2 mm), an A4 size (sheet width of 210.0 mm), and a letter size (sheet width of 215.9 mm) are specified as the candidates for the sheet size.

Further, in the above example, the sheet size included in a predetermined range (for example, ±3 mm) is specified based on a result of the sheet width detection executed by the sheet sensor 118. However, the predetermined range is not limited to the above, and thus the sheet size that is included in a range larger than a detection result by a predetermined width (for example, +3 mm) may be specified, or on the contrary, the sheet size that is included in a range smaller than a detection result by a predetermined width may be specified. Further, the above predetermined range may be changed according to the type of printing sheet 104 (e.g., normal paper or glossy paper). For example, in a case where a glossy paper is used as the printing sheet 104, intensity of light reflected therefrom is greater than that from a normal paper. In this case, the output level acquired by the sheet sensor 118 exceeds the threshold value Vth at a position where the printing sheet 104 does not actually exist, and thus the printing apparatus 100 may determine that the printing sheet 104 exists in that position. Therefore, for example, the predetermined range may be set as ±3 mm when the type of printing sheet 104 is a normal paper, while the predetermined range may be set as −6 mm when the type thereof is a glossy paper. Moreover, the above-described predetermined range may be set according to various conditions such as the characteristics of the sheet sensor 118.

Further, in the above description, the sheet size is determined by using the sheet size table of FIG. 4A. However, as another example, the sheet size table of FIG. 4B may be also used.

In addition to the items included in the sheet size table of FIG. 4A, the sheet size table of FIG. 4B includes an item of sheet information 304 which indicates a sheet having a similar sheet width. More specifically, the sheet sizes each having a mark with a symbol "x" in the table are the sheet sizes having similar sheet width corresponding to the sheet size in the table. For example, in the sheet size table, the A4 size and the letter size are designated as the sheet sizes having the similar sheet widths. Likewise, the Y6 western-style envelope size, the postcard size, and the 4×6 size are designated as the sheet sizes having the similar sheet widths.

The CPU 201 can refer to the sheet width 301 by reading the sheet size table of FIG. 4B from the program memory 203 to the data memory 204. Then, when the sheet width is detected by the sheet sensor 118, the CPU 201 specifies the sheet size corresponding to the detected sheet width. In a case where a sheet size having a sheet width similar to the sheet width of the specified sheet size is designated in the sheet size table, the CPU 201 specifies a plurality of sheet size candidates including that sheet size having the similar sheet width.

For example, in a case where the sheet width detected by the sheet sensor 118 is 90.0 mm, the L size is uniquely specified as the sheet size. On the other hand, in a case where the sheet width detected by the sheet sensor 118 is 99.0 mm, a postcard size having a sheet width that is the most similar to the detected sheet width is specified, and the Y6 western-style envelope size and the 4×6 size which are designated by the sheet information 304 are also specified in addition to the postcard size.

As described above, based on the sheet size table of FIG. 4A or FIG. 4B, the CPU 201 determines the sheet size of the printing sheet which includes the sheet length 302 in addition to the sheet width 301. Then, the CPU 201 executes printing processing according to the determined sheet size.

As described above, based on the sheet width detected by the sheet sensor 118 and the sheet width designated in the sheet size table, a plurality of candidates may be specified as the sheet size. Therefore, in the present exemplary embodiment, the CPU 201 determines the size of the printing sheet according to various conditions such as destination information of the printing apparatus 100. With this operation, as described above, the CPU 201 can determine the appropriate sheet size even in a case where the CPU 201 cannot specify the sheet size uniquely. Hereinbelow, sheet size detection processing will be described in detail.

Figure 5:
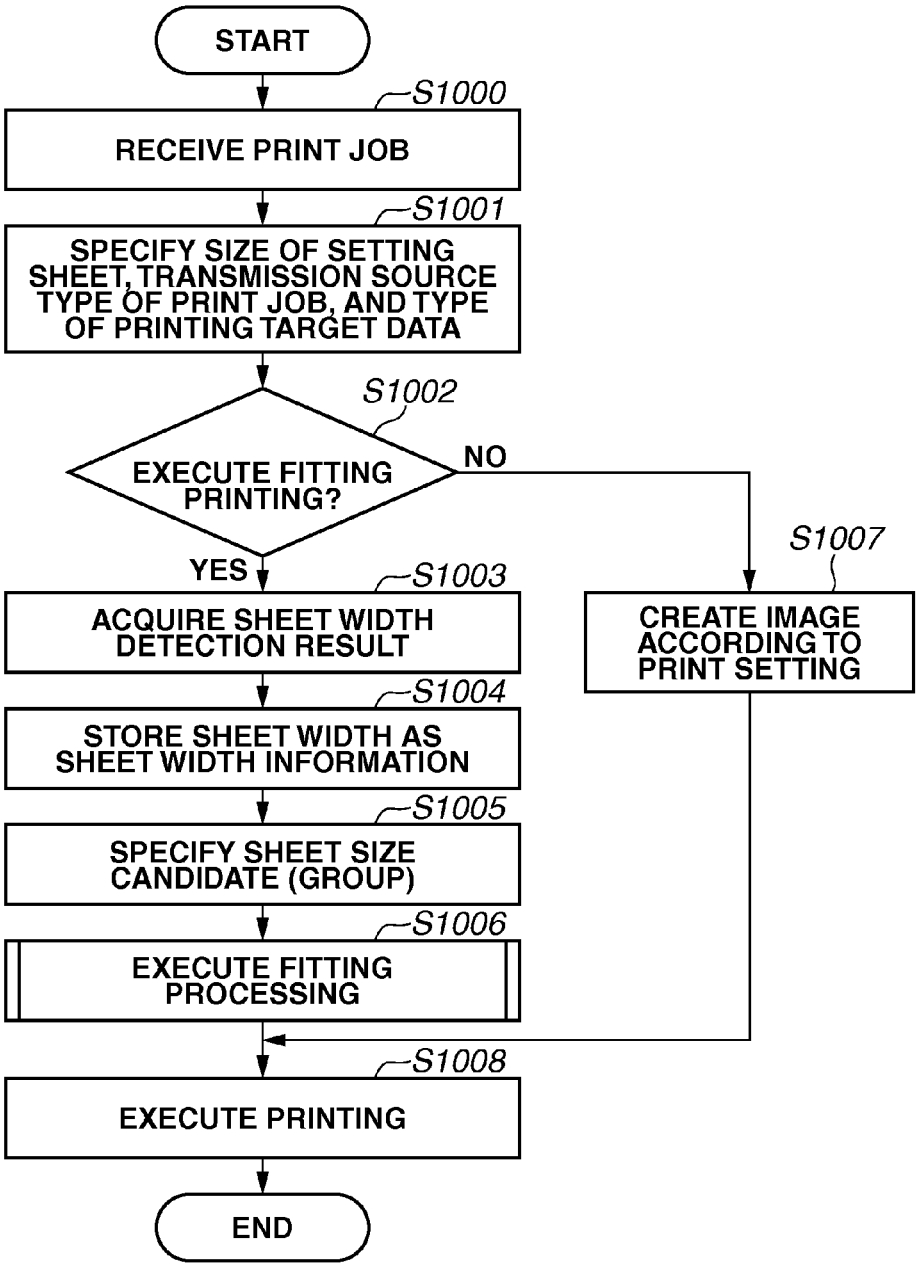
FIG. 5 is a flowchart illustrating an example of printing control processing performed by a central processing unit (CPU) 201.

FIG. 5 is a flowchart illustrating an example of printing control processing executed by the CPU 201. A program which corresponds to the processing of the flowchart illustrated in FIG. 5 is stored in the program memory 203. The CPU 201 can realize the processing in respective steps of the flowchart illustrated in FIG. 5 by reading out the program to the work memory 205 and executing the program in the work memory 205.

In step S1000, the CPU 201 receives a print job from an external apparatus via the interface control unit 207 and stores the print job in the data memory 204. The print job includes data such as an image that serves as a printing target of the printing apparatus 100 and print setting information that indicates the print setting such as a type of sheet used for printing the data.

After the print job is received in step S1000, in step S1001, the CPU 201 specifies a sheet size set by the print setting, a type of apparatus which transmits the print job, and a type of printing target data included in the print job.

Further, in step S1001, the CPU 201 analyzes the print setting information included in the print job received in step S1000. Then, the CPU 201 specifies a setting size (setting sheet size) of the printing sheet set to the printing target data corresponding to the print job in the print setting information. The setting sheet size included in the print setting information is set by the apparatus (i.e., server, host computer, or smart device) which transmits the print job received in step S1000. For example, if a user of the apparatus designates a size of the printing sheet through a screen of the apparatus, size information which indicates the designated size is registered to the print setting information as a setting sheet size, so that the print job which includes that print setting information is received in step S1000. In step S1001, a size of the printing sheet set in the above-described manner will be specified.

Further, the above print setting information is included in the print job as the information different from the printing target data. Therefore, the information that indicates the above setting sheet size is included separately from the printing target data. In addition, the print setting information including the setting sheet size may be transmitted to the printing apparatus 100 as a single file such as a digital print order format (DPOF) file. In other words, the print setting information may be transmitted to the printing apparatus 100 as another file that is separated from the printing target data (e.g., joint photographic experts group (JPEG) file).

However, depending on the apparatus that transmits the print job received in step S1000 or the application that gives a printing instruction in the print job, setting information of the size of the printing sheet may or may not be included in the print setting information. In step S1001, in a case where the setting information of the size of the printing sheet is included, the size indicated by the setting information is specified as the above-described setting sheet size.

Further, in order to determine the type of apparatus, for example, the CPU 201 may determine the type based on a communication protocol for receiving the print job from the external apparatus, or the CPU 201 may determine the type based on the information indicating the type of external apparatus, received from the external apparatus. Further, the CPU 201 may determine the type of printing target data by checking an extension of a printing target file, or the CPU 201 may determine the type thereof based on the information indicating the type of printing target data received from the apparatus that transmits the print job.

In step S1002, according to the type of apparatus and the type of printing target data specified in step S1001, the CPU 201 determines whether to execute fitting printing in which the image of the printing target is printed by being adjusted to the size of the printing sheet stored in the printing apparatus 100. More specifically, the CPU 201 respectively determines whether the type of apparatus and the type of data specified in step S1001 are the predetermined types, and determines to execute the fitting printing when the types thereof are the predetermined types. For example, in a case where the printing apparatus 100 can receive the print job from the server, the host computer, or the smart device 208, the CPU 201 executes the fitting printing by determining the smart device 208 to be the above-described predetermined type of apparatus. Further, the CPU 201 checks a file format of the printing target data so as to determine whether the file format is a predetermined file format. The fitting printing can be executed on a photograph more reliably if the apparatus or the file format, which is more likely to select a photograph as a printing target, is set as the above-described predetermined type.

A JPEG format, a predetermined raster file format, and a portable document format (PDF) are included as the file formats that can be printed by the printing apparatus 100. Therefore, the JPEG format and the predetermined raster file format are the above-described predetermined types of file format. Thus, in step S1002, the CPU 201 determines to execute the fitting printing if the file format specified in step S1001 is the predetermined file format. On the other hand, in a case where the file format specified in step S1001 is the PDF format, the CPU 201 determines not to execute the fitting printing.

Further, in step S1002, although the CPU 201 determines whether to execute the fitting printing based on both the type of apparatus and the type of printing target data, the determination processing may be executed based on either one of the above types. For example, as a file format for the image captured by an imaging apparatus, the image may be stored in a memory as a JPEG format. Therefore, in step S1002, the CPU 201 may determine to execute the fitting printing when the printing target data is the JPEG format.

In addition, various types of information can be specified in step S1001, so as to serve as the conditions of the determination processing in step S1002. For example, the CPU 201 may execute the fitting printing when a printing mode set to the printing apparatus 100 is a fitting printing mode. Further, in a case where the printing apparatus 100 is provided with a plurality of interfaces, the CPU 201 may determine to execute the fitting printing according to the interface used for receiving the print job in step S1000. Furthermore, the CPU 201 may determine not to execute the fitting printing in a case where "same size printing" is designated by the print setting information.

In addition to the above conditions, the CPU 201 may execute the fitting printing in a case where the sheet size is not designated by the print setting information included in the print job received in step S1001. In addition to the above case where the sheet size is not designated, for example, the fitting printing may be also executed in a case where the information indicating the sheet size is not included in the print setting information, or in a case where the information for instructing the fitting printing is included in the print setting information as the information of the sheet size.

Furthermore, in addition to the above conditions, the CPU 201 may determine whether to execute the fitting printing according to whether the user inputs, through the screen, an instruction for executing the fitting printing according to the sheet width detection executed by the sheet sensor 118. For example, the CPU 201 of the printing apparatus 100 displays a screen which includes a checkbox for allowing the user to execute the above instruction on the operation panel 218, so that the CPU 201 executes the fitting printing when the user checks the checkbox. Alternatively, the above screen may be displayed on an external apparatus that transmits the printing data to the printing apparatus 100, so that the user instructs the fitting printing through that external apparatus. In this case, the external apparatus transmits the information for causing the printing apparatus 100 to execute the fitting printing to the printing apparatus 100 by including or attaching the information in/to the print job data. In step S1002, the CPU 201 of the printing apparatus 100 determines whether to execute the fitting printing based on whether the CPU 201 has received the above information from the external apparatus. In addition, the above screen displayed on the operation panel 218 or the external apparatus will be displayed prior to printing processing. Then, in step S1002, when the printing processing is to be executed, the CPU 201 determines whether to execute the fitting printing by checking the content of the instruction previously given by the user. Alternatively, the above screen may be displayed to allow a user to give an instruction when the printing processing is to be executed.

Further, in a case where the above instruction for executing the fitting printing is not given by the user, in step S1002, the CPU 201 may determine not to execute the fitting printing regardless of the type of apparatus and the type of printing target data specified in step S1001. In other words, the CPU 201 may determine to execute the fitting printing in a case where the user gives the above instruction, and the type of apparatus and the type of printing target data are the predetermined types.

In step S1002, in a case where the CPU 201 determines to execute the fitting printing (YES in step S1002), the CPU 201 executes the processing in steps S1003 through S1006. On the other hand, in a case where the CPU 201 determines not to execute the fitting printing (NO in step S1002), the processing proceeds to step S1007.

In step S1003, the CPU 201 executes the sheet width detection processing illustrated in FIG. 2 by driving the carriage 113 and the sheet sensor 118 using the motor control unit 209 and the sensor control unit 214. Next, in step S1004, the CPU 201 stores the sheet width acquired from the sheet width detection executed in step S1003 in the work memory 205 as the sheet width information.

Next, in step S1005, the CPU 201 refers to the sheet width information stored in step S1004 and the sheet size table of FIG. 4, and specifies one or more sheet sizes from among standard sizes supported by the printing apparatus 100 as the candidates for the size of the printing medium. As described above, depending on the sheet width information stored in step S1004, a plurality of sheet sizes may be extracted as the candidates for the size of the printing medium. This extracted sheet size (group) is stored in the work memory 205 as the sheet size candidate information.

Next, in step S1006, the CPU 201 executes fitting processing for creating an image of the printing target on the image memory 206 according to the size of the printing medium conveyed in the printing apparatus 100. The fitting processing will be described in detail below with reference to FIG. 7.

In step S1002, if the CPU 201 determines not to execute the fitting printing (NO in step S1002), the processing proceeds to step S1007. In step S1007, the CPU 201 creates the image of the printing target on the image memory 206 according to the print setting designated by the print setting information. For example, in a case where the image data of the printing target is included in the print job, and in the print setting, "enlargement/reduction printing" and "A4 size" are set as a printing method and a printing sheet size respectively, the CPU 201 rasterizes the image data and scales the rasterized image to adjust to the A4 size. Further, in a case where "same size printing" is designated as the printing method, the CPU 201 creates the image of the printing target without executing the above-described scaling processing. Furthermore, in a case where "borderless printing" is designated, the image of the printing target is arranged in a layout region where the size of the printing sheet designated by the print setting is enlarged by a borderless magnification ratio.

In step S1008, the CPU 201 outputs the image of the printing target created on the image memory 206 in step S1006 or S1007 to the head control unit 213. Then, the CPU 201 prints the printing target image on the printing medium by driving the printing head 112 and the carriage 113.

When the CPU 201 creates the printing target image in step S1006 or S1007, the CPU 201 rasterizes bitmap data on the image memory 206 by executing decompression processing if the printing target data is the image data such as a JPEG image file. Furthermore, in a case where the printing target data is vector data, the CPU 201 rasterizes bitmap data on the image memory 206 by executing rendering processing.

As described above, through the processing illustrated in the flowchart of FIG. 5, the image having a size according to the print setting or a size based on the detection result of the sheet sensor 118 is printed by the printing apparatus 100.

In the present exemplary embodiment, in a case where a plurality of candidates is specified as the sheet size based on the sheet width detected by the sheet sensor 118 and the sheet size table, the CPU 201 determines the size of the printing sheet according to the condition such as the destination information of the printing apparatus 100. Specifically, the CPU 201 determines the size of the printing sheet by comparing the destination information of the printing apparatus 100 and the sheet type used for printing with those included in a table illustrated in FIG. 6.

FIG. 6 is a table illustrating a relationship between a sheet size and a priority level.

In FIG. 6, a priority table 400 includes a type 401, a priority country 402, and a use frequency 403. The type 401 is the information indicating a sheet type (normal paper, glossy paper, envelope size, or postcard size) corresponding to each sheet size. The priority country 402 is the region information indicating a country where the printing apparatus 100 is shipped or distributed, and each sheet size is frequently used, among the countries where the printing apparatus 100 is shipped and distributed. In the present exemplary embodiment, the region information represents a country. However, the region information may represent either a country or a region, or may represent both. By referring to the above region information, the CPU 201 can specify the country or the region where the printing apparatus 100 is used. Further, because there is a trend in size of the printing sheet used for printing in each country or region, the CPU 201 can specify the size of the printing sheet that is more likely to be used by the printing apparatus 100 by referring to the region information.

The use frequency 403 is the information indicating the use frequency in the priority country 402. In the present exemplary embodiment, either Japan (JP) or the United States of America (USA) is specified as a candidate for the country or the region indicated by the destination information. For example, as for the Y6 western-style envelope size, a type of sheet size corresponds to "envelope size", and the Y6 western-style envelope size is more likely to be used in Japan rather than in the USA while the use frequency is "low" in Japan. Furthermore, as for the letter size, a type of sheet size corresponds to "others", and the letter size is more likely to be used in the US rather than in Japan while the use frequency is "moderate" in the US.

In addition, this priority table 400 is stored in the program memory 203 so that the CPU 201 can refer to the priority table 400 by reading the priority table 400 from the program memory 203 to the work memory 205. When the printing apparatus 100 is shipped out, a country of destination is previously stored in the program memory 203 as the destination information of the printing apparatus 100.

In the present exemplary embodiment, in a case where a plurality of candidates is specified as the size of the printing sheet, the CPU 201 determines a high-priority sheet size from among a plurality of sheet size candidates as the size of the printing sheet by referring to the destination information of the printing apparatus 100, the sheet type, and the priority table 400. In this manner, through the fitting processing in step S1006 of FIG. 5, the CPU 201 determines the size of the printing sheet and creates the printing target image according to the determined size of the printing sheet.

Figure 7:
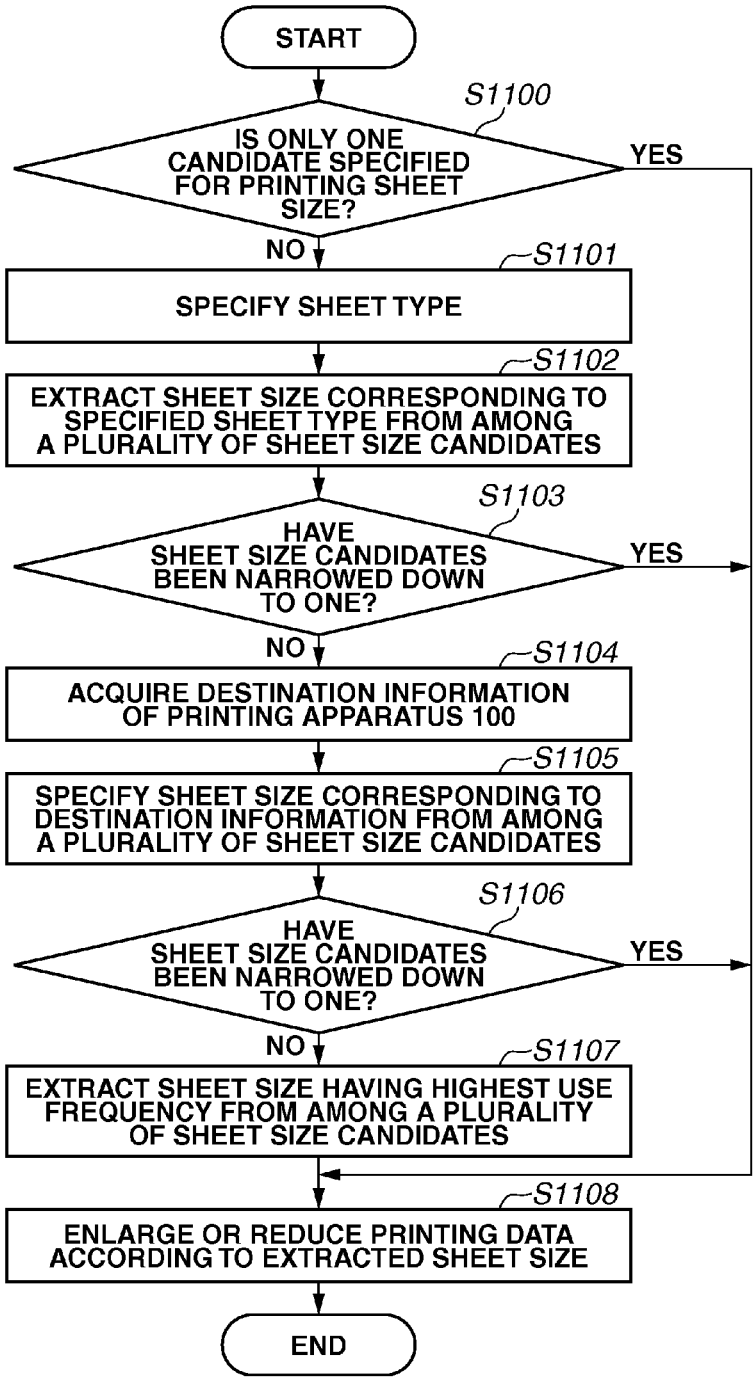
FIG. 7 is a flowchart illustrating fitting processing executed in step S1006 of FIG. 5.

FIG. 7 is a flowchart illustrating the fitting processing executed in step S1006 of FIG. 5.

In step S1100, the CPU 201 determines whether only one candidate is specified as the size of the printing sheet based on a result of the sheet width detection executed by the sheet sensor 18 in step S1005 of FIG. 5. In a case where the only one candidate is specified (YES in step S1100), the CPU 201 advances the processing to step S1108 while omitting the processing in steps S1101 through S1107 described below because the CPU 201 does not have to execute the processing for narrowing down a plurality of candidates. On the other hand, in a case where a plurality of candidates are specified as the size of the printing sheet (NO in step S1100), the processing proceeds to step S1101.

In step S1101, the CPU 201 specifies type information which indicates the sheet type (normal paper, glossy paper, postcard size, or envelope size) corresponding to the print job received in step S1000 of FIG. 5. In order to specify the sheet type, for example, the CPU 201 may refer to the sheet type designated by the print setting included in the print job. Alternatively, in a case where the information for specifying a function (application) that has transmitted the print job is included in the print job, the CPU 201 may determine the sheet type according to that information. For example, the CPU 201 may specify "others" as the sheet type if the print job is issued from the application for printing a photograph, whereas the CPU 201 may specify "postcard size" as the sheet type if the print job is issued from the application for printing a postcard. Further, in a case where printing for a specific purpose (e.g., photograph printing or postcard printing) is executed through the printing control processing in FIG. 5, the CPU 201 may specify the sheet type according to that purpose. For example, the CPU 201 specifies "others" as the sheet type when printing is executed for the photograph printing, whereas the CPU 201 specifies "postcard size" as the sheet type when printing is executed for the postcard printing. In this manner, when the sheet type is specified in step S1101, the processing proceeds to step S1102.

In step S1102, the CPU 201 extracts a candidate corresponding to the sheet type specified in step S1101 from among a plurality of the sheet size candidates extracted in step S1005 of FIG. 5 by referring to the type 401 of the priority table 400. For example, in a case where "double postcard size", "6P size", "A4 size", and "letter size" are the sheet size candidates while "postcard size" is specified as the sheet type for the printing processing in step S1101, "double postcard size" will be extracted. Furthermore, in a case where "double postcard size", "6P size", "A4 size", and "letter size" are the sheet size candidates while "others" is specified as the sheet type, "6P size", "A4 size", and "letter size" will be extracted.

In step S1103, the CPU 201 determines whether the candidates for the sheet size are narrowed down to one candidate in step S1102. In a case where the candidates are narrowed down to one candidate (YES in step S1103), the processing proceeds to step S1108. On the other hand, in a case where more than one candidates are extracted (NO in step S1103), the processing proceeds to step S1104.

In step S1104, the CPU 201 acquires the destination information of the printing apparatus 100 from the program memory 203. In the present exemplary embodiment, the destination information which indicates a destination country where the printing apparatus 100 is to be shipped is previously stored in the program memory 203, so that the CPU 201 can refer to the destination country of the printing apparatus 100 by reading the destination information into the work memory 205.

In step S1105, the CPU 201 refers to the priority country 402 in the priority table 400 illustrated in FIG. 6. Then, the CPU 201 extracts the sheet size corresponding to the destination information of the printing apparatus 100 acquired in step S1104 from among a plurality of the candidates extracted in step S1102. For example, as described above, "6P size" and "A4 size" will be extracted in a case where "6P size", "A4 size", and "letter size" are extracted in step S1102 and if the destination information acquired in step S1104 corresponds to Japan.

In step S1106, the CPU 201 determines whether the candidates for the sheet size are narrowed down to one candidate in step S1102. In a case where the candidates are narrowed down to one candidate (YES in step S1106), the processing proceeds to step S1108. On the other hand, in a case where more than one candidate are extracted for the sheet size (NO in step S1106), the processing proceeds to step S1107.

In step S1107, the CPU 201 extracts the sheet size having the highest use frequency from among a plurality of the candidates extracted in step S1105 by referring to the use frequency 403 in the priority table 400 illustrated in FIG. 6. For example, in a case where "6P size" and "A4 size" are extracted in step S1105, "A4 size" is extracted in step S1107. When the sheet size is extracted in step S1107, the processing proceeds to step S1108.

In step S1108, the CPU 201 executes fitting processing. More specifically, the CPU 201 creates printing data according to the sheet size narrowed by the processing in steps S1101 through S1107. For example, in a case where the printing target is image data, the CPU 201 creates printing data on the image memory 206 according to a sheet size by scaling an image corresponding to the image data according to the sheet size. Further, in a case where the printing target is vector data, the CPU 201 executes scaling processing according to the sheet size and creates bitmap data on the image memory 206 based on the post-scaled vector data.

Further, the processing described with reference to FIG. 7 will be further described by taking another case as an example. Suppose, for example, "Y6 western-style envelope size", "postcard size", and "4×6 size" are detected as the sheet size candidates of the printing sheet conveyed by the printing apparatus 100 in step S1003 of FIG. 5. Then, if "envelope size" is specified as the sheet type in step S1101 of FIG. 7, the sheet size "Y6 western-style envelope size" is determined to be the size of the above printing sheet in step S1102. Further, if "L size", "Y6 western-style envelope size", "postcard size", and "4×6 size" are specified as the sheet size in step S1003 of FIG. 5 and "others" is specified as the sheet type in step S1101, "L size" and "4×6 size" are determined to be the sizes of the printing sheet in step S1102. Then, in step S1104, in a case where the acquired destination information of the printing apparatus 100 corresponds to the destination country "US", "4×6 size" will be determined to be the sheet size thereof.

As described above, with the fitting processing (i.e., processing in step S1006 of FIG. 5) illustrated in FIG. 7, in a case where a plurality of sheet size candidates is acquired based on the detection result of the sheet sensor 118 in step S1003 of FIG. 5, the CPU 201 can determine the sheet size based on the destination information of the printing apparatus 100.

Accordingly, even if the size of the printing sheet cannot be uniquely specified by the sheet sensor 118, the CPU 201 can create the printing target image corresponding to a determined sheet size by determining an appropriate sheet size.

Furthermore, as illustrated in FIG. 7, in a case where a plurality of sheet size candidates is specified by a result of the sheet width detection executed by the sheet sensor 118, the sheet sizes are narrowed down based on a plurality of conditions (i.e., sheet type, destination information, and use frequency). More specifically, candidates are narrowed down based on conditions according to the plurality of candidates from among the plurality of the conditions, so as to uniquely specify the sheet size.

Further, in the example of FIG. 7, the CPU 201 executes determination processing by sequentially using a plurality of the conditions as in steps S1102, S1105, and S1107, and narrows down the candidates. However, it is not limited thereto. For example, a table in which a plurality of sheet size candidates and a sheet size that is acquired by narrowing down the plurality of sheet size candidates based on the above-described plurality of conditions are associated with each other may be stored in the program memory 203 in advance. In this case, the CPU 201 can uniquely specify the sheet size in which a plurality of conditions is taken into consideration by referring to the table based on the plurality of candidates. Further, when the above-described table is prepared, the CPU 201 can specify the sheet size according to the destination by storing the table according to the destination of the printing apparatus 100 in the program memory 203. Alternatively, a plurality of tables according to a plurality of destinations may be stored in the program memory 203, so that the CPU 201 may refer to a table corresponding to a destination of the printing apparatus 100 by checking the destination thereof when the CPU 201 narrows down the sheet sizes.

Furthermore, as another example of the above table, from among a plurality of conditions for narrowing down a plurality of candidates, a table indicating the conditions that can narrow down a plurality of the candidates may be previously stored in the program memory 203. For example, if a plurality of the candidates is the 6P size, the A4 size, and the letter size, the destination information and the use frequency are registered on the table as a plurality of the conditions that can narrow down a plurality of the candidates in association therewith. Further, if a plurality of the candidates is the L size and the Y6 western-style envelope size, the sheet type and the use frequency are associated therewith as a plurality of the conditions that can narrow down a plurality of the candidates.

In the above-described exemplary embodiment, the destination information of the printing apparatus 100 has been previously stored in the program memory 203. However, it is not limited thereto. For example, when the user uses the printing apparatus 100, the user may specify the country or the region where the printing apparatus 100 is used to store the destination information indicating the specified country or region in the program memory 203.

Further, in FIG. 6, the use frequency of each sheet size has been included in the priority table 400 in advance. However, it is not limited thereto. For example, each time the printing apparatus 100 executes printing, the CPU 201 may count the number of times each sheet size is used and store that count value in the program memory 203. Then, when the CPU 201 narrows down a plurality of sheet size candidates, the CPU 201 refers to the count value stored in the program memory 203 by taking that count value as the use frequency. With this operation, the CPU 201 can refer to the actual number of times each sheet size is used for printing processing of the printing apparatus 100, so that the CPU 201 can determine the sheet size by using the use frequency individually corresponding to the printing apparatus 100.

Further, in FIG. 7, the sheet type, the priority country, and the use frequency are used as the conditions for determining the sheet size. However, contents of the printing target data may be employed as another condition for determining the sheet size. For example, after analyzing the data of the printing target, if black and white are used for printing the data, the CPU 201 may prioritize the sheet size such as the envelope size used for printing text over the sheet size such as the L size normally used for printing a photograph.

Alternatively, for example, the CPU 201 may determine the sheet size according to an extension by acquiring a file extension of the printing target. For example, if the extension is ".jpg", the CPU 201 may determine that the content of the image is a photograph and prioritize the sheet size such as the L size normally used for printing a photograph as the sheet size therefor.

Further, in the above-described exemplary embodiment, a country has been taken as an example of the destination region of the printing apparatus 100 or the region indicated by the priority table 400 in FIG. 6. However, the region is not limited thereto, and a region including a plurality of countries (for example, Asia, North America, or Europe), or a divided region within a country (for example, city or state) may be employed as the destination region of the printing apparatus 100 or the region indicated by the priority table 400. Furthermore, in the above-described exemplary embodiment, the destination region has been specified according to the destination information indicating the destination region of the printing apparatus 100. However, it is not limited thereto, and the destination region of the printing apparatus 100 may be specified according to various kinds of information such as a language setting that is set to the printing apparatus 100.

Further, in the processing illustrated in FIG. 7, determination processing for narrowing down the sheet sizes has been executed in the order of determination according to the sheet type (in step S1102), determination according to the destination information (in step S1105), and determination according to a predetermined priority order based on the use frequency (in step S1107). By prioritizing the determination according to the sheet type (in step S1102) over other kinds of determination, the CPU 201 can reliably specify the appropriate size of the printing sheet with respect to the printing target data in the printing processing. Because the sheet type is determined according to the user setting or the application, the sheet size thereof is more likely to be suitable for the size of the printing sheet used in the printing processing. Therefore, the CPU 201 can specify the appropriate size of the printing sheet more reliably by prioritizing and referring to the sheet type.

However, the processing order is not limited to the above-described order, and the determination processing may be executed in another processing order, or the order of the determination processing may be changed according to various conditions. For example, the order of the determination processing may be changed according to the candidates for the size of the printing sheet specified by the sheet width detected by the sheet sensor 118. More specifically, if the A4 size and the letter size are specified as the candidates for the size of the printing sheet, the determination processing according to destination information executed in step S1105 is executed in priority to other kinds of determination processing. In this case, through the determination processing according to the destination information, the size of the printing sheet can be uniquely specified to either of the A4 size or the letter size, so that the CPU 201 can specify the size of the printing sheet without executing the determination processing in steps S1102 and S1107. Further, for example, if the Y6 western-style envelope size, the postcard size, and the 4×6 size are specified as the candidates for the size of the printing sheet, the determination processing according to the sheet type (in step S1102) may be prioritized over other kinds of determination processing. In this case, because respective sheet types corresponding to these three candidates are different from each other, the CPU 201 can uniquely specify the size of the printing sheet by executing the determination processing according to the sheet type without executing other kinds of determination processing.

Furthermore, in the above-described exemplary embodiment, the CPU 201 has specified a standard size as the size of the printing sheet by narrowing down the standard size candidates specified by the sheet width detected by the sheet sensor 118. However, it is not limited thereto, and the CPU 201 may specify a non-standard size as the size of the printing sheet based on the standard size candidates by specifying the standard size candidates according to the sheet width detected by the sheet sensor 118.

For example, in the determination processing in step S1106 of FIG. 7, if the standard size candidates are not narrowed down to one, a non-standard size may be specified according to the plurality of candidates and various conditions at that time. More specifically, the CPU 201 may specify the non-standard size according to whether "borderless printing" for executing printing without having a margin at a border of the printing sheet is designated as a print setting of the printing processing. In "borderless printing", an image of the printing target is created to become larger than the size of the printing sheet in order to eliminate the margin on the border of the printing sheet when the image is printed. In other words, "borderless printing" can be realized by printing the image larger than the printing sheet.

Suppose, for example, a plurality of standard size candidates is specified by the determination processing in step S1106 when "borderless printing" is designated. In this case, the CPU 201 specifies the greatest sheet width from among the sheet widths of a plurality of the standard size candidates, and the greatest sheet length from among the sheet lengths of a plurality of the standard size candidates are specified as respective sizes for the non-standard printing sheet. With this operation, the borderless printing can be realized even if the size of the printing sheet actually used for printing is any of the above-described plurality of the candidates. For example, in a case where the A4 size and the letter size are included in the standard size candidates, in the determination processing in step S1106, it is determined that both the A4 size and the letter size remain as the candidates. Therefore, in a case where "borderless printing" is designated, the CPU 201 specifies the sheet width of the letter size and the sheet length of the A4 size as the respective sizes of the printing sheet. As a result, even if any one of the A4 size and the letter size is used for printing, the image larger than the printing sheet can be printed.

On the other hand, in a case where "borderless printing" is not designated, the smallest sheet width from among the sheet widths of a plurality of the standard size candidates, and the smallest sheet length from among the sheet lengths of a plurality of the standard size candidates are specified as respective sizes as the non-standard sheet. With this operation, for example, in a case where the user turns off the borderless print setting in order to have a margin on the border of the printing sheet, the margin can be appropriately provided on the border of the printing sheet because the image smaller than the printing sheet is printed thereon.

Further, in the above-described exemplary embodiment, when the printing apparatus 100 receives a print job from the external apparatus, the CPU 201 has executed printing according to a determined sheet size by determining a sheet size of the printing sheet. However, it is not limited thereto, and the CPU 201 may determine the sheet size based on the copy function in which a scanned image read by the scanner 220 included in the printing apparatus 100 is printed on the printing sheet.

Figure 8:
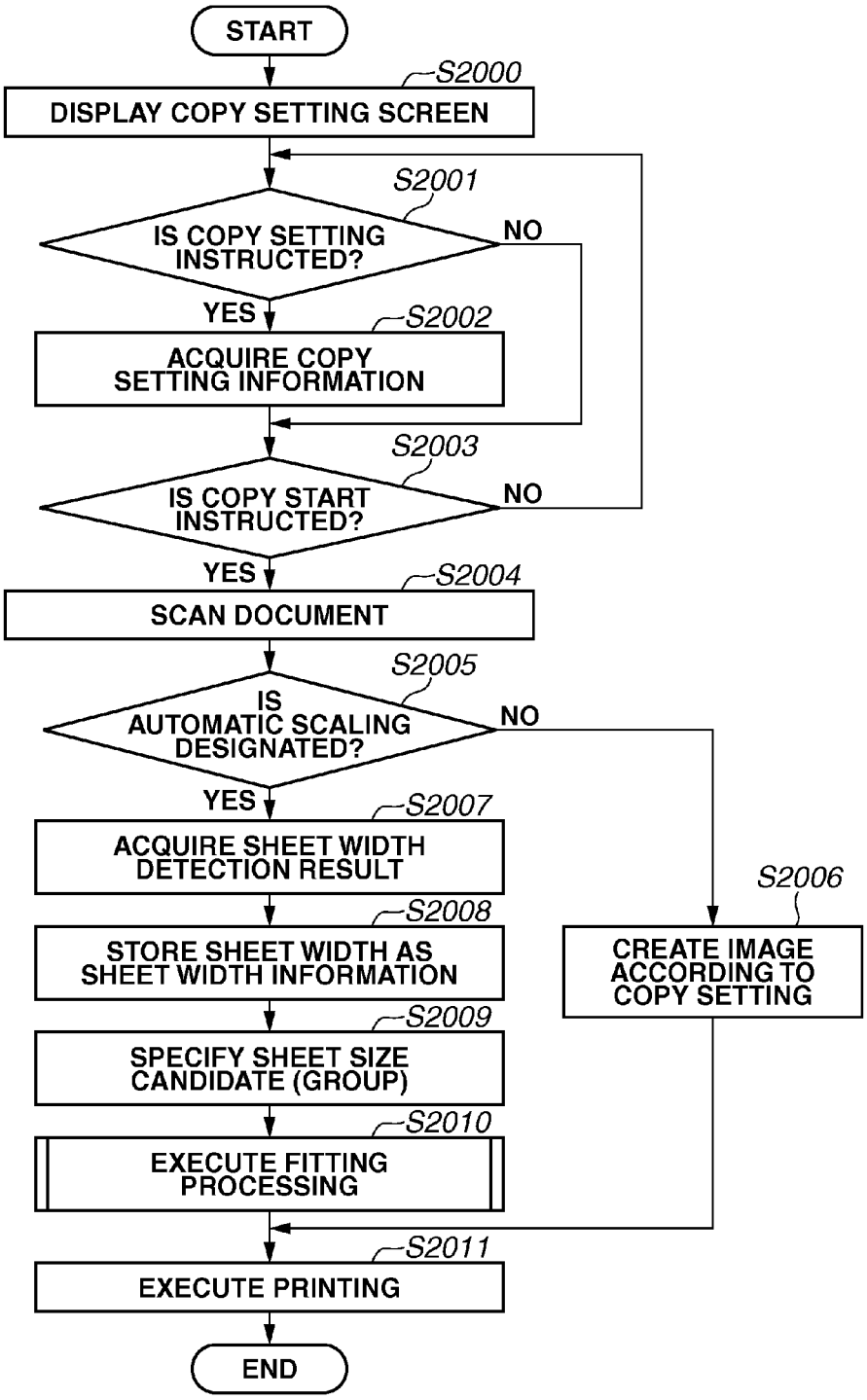
FIG. 8 is a flowchart illustrating an example of printing control processing in copy function.

FIG. 8 is a flowchart illustrating an example of printing control processing in the copy function. In a similar manner to the processing illustrated in FIG. 5, the processing illustrated in the flowchart of FIG. 8 is executed by the CPU 201. Further, the processing illustrated in the flowchart of FIG. 8 is executed when the user selects the copy function using the operation panel 218 of the printing apparatus 100 and an instruction for executing the copy function is input to the CPU 201.

In step S2000, the CPU 201 causes the panel control unit 217 to display a setting screen for allowing a user to designate a copy setting or a copy start in the copy function on a display panel of the operation panel 218. A sheet size of the printing sheet to be printed by the copy function, number of copies, designation of whether to provide a margin (border) on the printing sheet, and printing density are included as the items that can be set by the copy setting screen. Copy setting information indicating a default setting of the copy setting is stored in the program memory 203, so that the CPU 201 displays the default setting on the copy setting screen by reading the copy setting information to the data memory 204. The user can instruct the copy setting by changing the default setting.

The above copy setting includes a scaling setting about the scaling (enlargement or reduction) of a scanned image read by the scanner 220. In a case where "same size setting" is designated, for example, the scanned image is printed without being scaled. Further, in a case where the user designates a scaling ratio, the scanned image is scaled at the designated scaling ratio. Furthermore, in a case where the user designates an automatic scaling, scaling processing (fitting processing) is executed in order to fit the scanned image into a size of the sheet stored in the printing apparatus 100.

In step S2001, the CPU 201 determines whether the user instructs the copy setting through the operation panel 218. If the CPU 201 determines that the copy setting is instructed (YES in step S2001), the processing proceeds to step S2002. If the CPU 201 determines that the copy setting is not instructed (NO in step S2001), the processing proceeds to step S2003.

In step S2002, the CPU 201 acquires the copy setting information indicating the copy setting designated by the user through the operation panel 218 via the panel control unit 217. In step S2002, the CPU 201 rewrites the copy setting information stored in the data memory 204 to the copy setting information designated by the user. In step S2003, the CPU 201 determines whether the copy start is instructed by the user. If the CPU 201 determines that the copy start is instructed (YES in step S2003), the processing proceeds to step S2004. If the CPU 201 determines that the copy start is not instructed (NO in step S2003), the processing returns to step S2001. In step S2004, the CPU 201 causes the scanner control unit 219 to read the document through the scanner 220.

Next, in step S2005, the CPU 201 determines whether "automatic scaling" is designated by the copy setting information stored in the data memory 204. If the automatic scaling is not designated (NO in step S2005), the processing proceeds to step S2006. In step S2006, the CPU 201 creates an image of the printing target on the image memory 206 according to the scaling setting designated by the copy setting information.

On the other hand, in step S2005, if the CPU 201 determines that the automatic scaling is designated (YES in step S2005), the CPU 201 executes the processing in steps S2007 through S2010. In steps S2007 through S2010, the size of the printing sheet conveyed by the printing apparatus 100 is determined, and the scanned image acquired by the reading processing in step S2004 is scaled according to the determined sheet size. The processing in steps S2007 through S2010 is similar to the above-described processing in steps S1003 through S1006, and thus the detailed description thereof will be omitted.

In step S2011, the CPU 201 outputs the printing target image created on the image memory 206 in step S2006 or S2010 to the head control unit 213. Then, the CPU 201 prints the printing target image on a printing medium by driving the printing head 112 and the carriage 113.

As described above, in the processing illustrated in FIG. 8, when the scaling setting specified by the copy setting information is "automatic scaling", the image can be printed according to the size of the sheet, which is determined by the sheet sensor 118 and is conveyed by the printing apparatus 100.

Further, in a case where a plurality of candidates for the sheet size is specified based on the detection processing executed by the sheet sensor 118 in step S2007 of FIG. 8, the sheet size can be determined by the destination information of the printing apparatus 100. Accordingly, even if the size of the printing sheet cannot be specified uniquely by the sheet sensor 118, the CPU 201 can determine the appropriate sheet size to create the printing data according to the determined sheet size.

According to the above-described exemplary embodiment, in a case where a plurality of candidates for the sheet size is specified by the sheet width detection executed by the sheet sensor 118, a plurality of the candidates are narrowed down according to one or more conditions from among a plurality of conditions (i.e., sheet type, destination information, and use frequency), which corresponds to a plurality of the candidates.

Therefore, even if the CPU 201 cannot uniquely narrows down the candidates by a single condition, the CPU 201 can uniquely specify the sheet size by referring to a plurality of conditions. Further, the CPU 201 refers to a second condition if the priority level of a plurality of the candidates is equal to that in a first condition. Thus, the CPU 201 can be prevented from narrowing down the candidates based on the first condition to specify the inappropriate sheet size.

Further, in the above-described exemplary embodiment, the CPU 201 has determined the size of the printing sheet based on the detection result of the sheet sensor 118 when printing has been executed by the printing apparatus 100 based on the print job received from the external apparatus, or when the copy function has been executed by the printing apparatus 100. However, it is not limited thereto. For example, the CPU 201 may execute the above determination processing of the size of the printing sheet when the printing apparatus 100 prints an image stored in the memory card 223 mounted on the memory card slot 222 according to the print setting set by the user via the operation panel 218. For example, the CPU 201 may execute the above-described size determination processing in a case where the sheet size is not designated in the print setting information indicating the print setting designated by the user. In addition to the above case where the sheet size is not specified in the print setting information, the determination processing may be executed in a case where the sheet size is not included in the print setting information. Further, the determination processing may be executed in a case where an instruction for executing the setting processing of the sheet size according to a result of the sheet width detection executed by the sheet sensor 118 is included in the print setting information.

Furthermore, in a case where the printing apparatus 100 executes printing according to the print setting designated by the user, the printing apparatus 100 may print an image stored in an internal memory included in the printing apparatus 100 in addition to the image stored in the external memory such as the memory card 223. In addition, the printing apparatus 100 may also print an image stored in the external apparatus such as a server connected to the printing apparatus 100 via the network according to the print setting designated by the user via the operation panel 218 of the printing apparatus 100.

Further, in the above-described exemplary embodiment, the sheet sensor 118 of the printing apparatus 100 has detected the sheet width. However, it is not limited thereto, and the sheet length may be detected by the sheet sensor 118, or both the sheet width and the sheet length may be detected thereby. In any of the above-described detection methods, in a case where a plurality of candidates exist as the size of the printing sheet used by the printing apparatus 100, the CPU 201 can determine the appropriate sheet size by executing the processing described in the above exemplary embodiment.

It is not limited to the case where the sheet size is automatically determined by using the sensor, and for example, the user may designates either a size of the sheet stored in a cassette of the printing apparatus or a size of the sheet inserted into a sheet feeding port of the printing apparatus through the operation panel of the printing apparatus. Then, the CPU 201 may execute the processing according to the above-described exemplary embodiment by applying the size designated by the user as the sheet size that is automatically determined by the sensor according to the exemplary embodiment.

Further, the user may designate the sheet size at any timing. For example, a sensor for detecting opening and closing of the cassette of the printing apparatus, or a sensor for detecting presence or absence of the sheet at the sheet feeding port may be disposed on the printing apparatus. Then, in a case where opening and closing of the cassette or placement of the sheet on the sheet feeding port is detected by the sensor, the CPU 201 displays a screen for allowing the user to designate the sheet size or the sheet type on the operation panel of the printing apparatus. Then, the size designated by the user through the above screen may be used as the size determined by the sensor according to the above-described exemplary embodiment.

Further, in the above-described exemplary embodiment, the CPU 201 included in the printing apparatus 100 has operated as an information processing apparatus to execute the determination processing of the sheet size illustrated in FIG. 7. However, it is not limited thereto, and an information processing apparatus, such as a host computer or a server connected to the printing apparatus 100 causing the printing apparatus 100 to execute printing may operate as a printing control apparatus according to the present exemplary embodiment to execute the processing according to the present exemplary embodiment.

More specifically, the host computer, the server, or the smart device executes the processing in steps S1001 through S1007 of FIG. 5 when the host computer, the server, or the smart device transmits a print job to the printing apparatus 100. In other words, the host computer, the server, or the smart device acquires the sheet width information of the printing sheet detected by the sheet sensor 118 of the printing apparatus 100 when the host computer, the server, or the smart device transmits the print job to the printing apparatus 100.

Then, the host computer, the server, or the smart device specifies the candidate for the size of the printing sheet according to the sheet width indicated by the acquired information, so as to determine a layout region according to the specified candidate and the setting sheet size. Thereafter, the host computer, the server, or the smart device rasterizes the printing target image on the layout region in the memory included therein, transmits the rasterized image to the printing apparatus 100 as a print job, and causes the printing apparatus 100 to execute printing. More specifically, the printing mechanism provided within the printing apparatus 100 prints the image received from the host computer, the server, or the smart device on a printing sheet according to the control by the CPU 201 of the printing apparatus 100.

Further, in another example in which the host computer, the server, or the smart device executes the processing according to the present exemplary embodiment, the size of the layout region in steps S1101 through S1107 of FIG. 7 may determined by the above device. In this case, the processing for scaling the printing target image in step S1108 is executed by the CPU 201 of the printing apparatus 100. With respect to the assignment of processing among the apparatuses such as the printing apparatus 100, and the host computer, the server, or the smart device, various configurations other than those described above can be applied to the present exemplary embodiment.

Further, in a case where the host computer executes the processing described according to the above exemplary embodiment, the host computer does not have to acquire the destination information of the printing apparatus 100 therefrom. For example, the host computer may specify the destination information by using the setting information of the software such as a printer driver or an application, which is installed in the host computer and causes the printing apparatus 100 to execute printing. More specifically, the host computer may specify a region where the printing apparatus 100 is used according to language information indicating a language setting or a user country setting of the above software, and determines the sheet size by determining the specified region as the destination region of the printing apparatus 100 according to the above exemplary embodiment.

Furthermore, in the above-described exemplary embodiment, a printing sheet is taken as an example of the printing medium on which the image is printed by the printing apparatus. However, the printing medium is not limited thereto, and the printing medium may be an overhead projector (OHP) sheet or a recording medium such as a compact disc (CD) or a digital versatile disc (DVD). The processing according to the present exemplary embodiment can be executed by referring to the region information, the type, and the use frequency which correspond to the size of the printing medium.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Further, a program code for realizing the function according to the present exemplary embodiment may be executed by a single computer such as a CPU or a micro processing unit (MPU), or may be executed by a plurality of computers that cooperate with each other. Further, the program code may be executed by the computer, or by the hardware such as a circuit which realizes the function of the program code. Furthermore, one part of the program code may be realized by the hardware whereas another part thereof may be executed by the computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-137056 filed Jun. 28, 2013, which is hereby incorporated by reference herein in its entirety.

What is claimed is:

1. An apparatus comprising:

an acquisition unit configured to acquire one or a plurality of candidates for a size of a printing medium, wherein the one or the plurality of candidates are based on a detection result by a sensor for detecting the size of the printing medium; and a printing control unit configured to cause a printing unit to print on the printing medium an image, wherein if the plurality of candidates acquired by the acquisition are narrowed down to one candidate corresponding to a combination of a plurality of conditions, the printing control unit causes the printing unit to print an image having a size corresponding to the one candidate, and wherein if the plurality of candidates cannot be narrowed down to one candidate by the plurality of conditions, the printing control unit causes the printing unit to print an image having a size corresponding to a candidate specified according to a predetermined priority order for a size of a printing medium.

2. The apparatus according to claim 1, comprising:

a specification unit configured to specify one or more candidates corresponding to the combination of the plurality of conditions from among the plurality of candidates;

wherein if the one candidate is specified from among the plurality of candidates by the specification unit, the printing control unit causes a printing unit to print an image having a size determined based on the candidate.

3. The apparatus according to claim 2, wherein the specification unit specifies a candidate corresponding to a combination of the plurality of conditions capable of narrowing down the plurality of candidates by sequentially using each of the plurality of conditions.

4. The apparatus according to claim 3, wherein the specification unit narrows down the plurality of candidates to one candidate by using a first condition, and narrows down the plurality of candidates by using a second condition in a case where the plurality of candidates cannot be narrowed down to one candidate by the first condition, so as to specify a candidate corresponding to a combination of the first condition and the second condition.

5. The apparatus according to claim 2, wherein the specification unit determines, according to the plurality of candidates, the plurality of conditions capable of narrowing down the plurality of candidates, and specifies a candidate corresponding to the combination of the plurality of determined conditions.

6. The apparatus according to claim 2, wherein, if the plurality of candidates cannot be narrowed down to one candidate by using the plurality of conditions, the specification unit specifies the one candidate according to a predetermined priority order for a size of a printing medium.

7. The apparatus according to claim 1, comprising:

a determination unit configured to determine use frequency of a size of a printing medium used for printing by the printing unit;

wherein the predetermined priority order is an order based on the use frequency determined by the determination unit and respectively corresponding to a plurality of sizes of the printing media.

8. The apparatus according to claim 1, wherein the plurality of conditions corresponds to at least any one of destination information indicating a country or a region corresponding to the apparatus, and a type of printing medium used for printing by the printing unit.

9. An apparatus comprising:

an acquisition unit configured to acquire one or a plurality of candidates for a size of a printing medium, wherein the one or the plurality of candidates are based on a detection result by a sensor for detecting the size of the printing medium; and a printing control unit configured to cause a printing unit to print on the printing medium an image having a size corresponding to a candidate corresponding to a combination of a plurality of conditions among the plurality of candidates acquired by the acquisition unit, wherein the plurality of conditions includes a condition corresponding to destination information indicating a country or a region corresponding to the apparatus, and wherein the printing control unit causes the printing unit to print an image having a size corresponding to a candidate which corresponds to a country or a region indicated by the destination information, and a country or a region corresponding to the plurality of the candidates.

10. The apparatus according to claim 9, wherein the destination information is acquired from a memory included in the apparatus.

11. The apparatus according to claim 9, wherein the destination information is language information indicating a language registered on the apparatus, and wherein the printing control unit causes the printing unit to print an image having a size determined based on a candidate corresponding to the language indicated by the language information, and a country or a region corresponding to the plurality of candidates.

12. The apparatus according to claim 1, wherein the printing unit conveys the printing medium to a position corresponding to a printing head to execute printing on the conveyed printing medium by the printing head, and the sensor is provided on a position corresponding to the printing head to detect a size of the printing medium when the printing medium is conveyed thereto.

13. The apparatus according to claim 1, wherein the acquisition unit acquires one or a plurality of candidates for a size of the printing medium acquired by the sensor detecting a width of the printing medium.

14. The apparatus according to claim 9, wherein the printing unit conveys the printing medium to a position corresponding to a printing head to execute printing on the conveyed printing medium by the printing head, and the sensor is provided on a position corresponding to the printing head to detect a size of the printing medium when the printing medium is conveyed thereto.

15. The apparatus according to claim 9, wherein the acquisition unit acquires the one or plurality of candidates for a size of the printing medium acquired by the sensor detecting a width of the printing medium.

16. The apparatus according to claim 9, wherein the plurality of conditions further includes a condition corresponding to a type of a printing medium used for printing by the printing unit.

17. A method comprising:

acquiring one or a plurality of candidates for a size of a printing medium acquired by a sensor for detecting a width of the printing medium wherein the one or the plurality of candidates are based on a detection result; and causing a printing unit to print on the printing medium an image wherein if the plurality of candidates acquired are narrowed down to one candidate corresponding to a combination of a plurality of conditions, printing an image having a size corresponding to the one candidate and wherein if the plurality of candidates cannot be narrowed down to one candidate by the plurality of conditions, printing an image having a size corresponding to a candidate specified according to a predetermined priority order for a size of a printing medium.

18. A method comprising:

acquiring one or a plurality of candidates for a size of a printing medium, wherein the one or the plurality of candidates are based on a detection result by a sensor for detecting the size of the printing medium; and printing on the printing medium an image having a size corresponding to a candidate corresponding to a combination of a plurality of conditions among the plurality of candidates acquired, wherein the plurality of conditions includes a condition corresponding to destination information indicating a country or a region corresponding to the apparatus, and wherein printing an image having a size corresponding to a candidate which corresponds to a country or a region indicated by the destination information, and a country or a region corresponding to the plurality of the candidates.

* * * * *